US010675831B2

(12) United States Patent
Gritti

(10) Patent No.: US 10,675,831 B2
(45) Date of Patent: Jun. 9, 2020

(54) AUTOMATIC MACHINE FOR PROVIDING CORRUGATED SHEET-LIKE ELEMENTS AND VANE FOR SAID MACHINE

(71) Applicant: Fabio Angelo Gritti, Cologno Al Serio (IT)

(72) Inventor: Fabio Angelo Gritti, Cologno Al Serio (IT)

(73) Assignee: GRIFAL S.P.A., Bergamo (IT)

( * ) Notice: Subject to any disclaimer, the term of this patent is extended or adjusted under 35 U.S.C. 154(b) by 295 days.

(21) Appl. No.: 15/548,704

(22) PCT Filed: Feb. 1, 2016

(86) PCT No.: PCT/EP2016/052081
§ 371 (c)(1),
(2) Date: Aug. 3, 2017

(87) PCT Pub. No.: WO2016/124548
PCT Pub. Date: Aug. 11, 2016

(65) Prior Publication Data

US 2018/0015683 A1 Jan. 18, 2018

(30) Foreign Application Priority Data

Feb. 4, 2015 (IT) ..... MI2015A0143

(51) Int. Cl.
*B65G 15/14* (2006.01)
*B31B 50/00* (2017.01)
*B31F 1/30* (2006.01)

(52) U.S. Cl.
CPC ..... *B31F 1/305* (2013.01)

(58) Field of Classification Search
CPC ..... B65G 15/14; B31F 1/305; B31B 50/00; B31B 50/254; B31B 2120/70; B31D 2205/0047; B31D 5/0047
(Continued)

(56) References Cited

U.S. PATENT DOCUMENTS 2,764,193 A * 9/1956 Knowles ..... B27D 1/06 144/254
3,044,921 A * 7/1962 Wentworth ..... B21D 47/00 156/205
(Continued)

FOREIGN PATENT DOCUMENTS

| | | |
|---|---|---|
| EP | 1620253 B1 | 5/2008 |
| FR | 1294625 A | 5/1962 |
| WO | 2014131667 A1 | 9/2014 |

OTHER PUBLICATIONS

International Search Report dated Apr. 13, 2016 re: Application No. PCT/EP2016/052081; pp. 1-3; citing: U.S. Pat. No. 3,157,551 A, FR 1 294 625 A and WO 2014/131667 Al.
(Continued)

*Primary Examiner* — Praachi M Pathak
(74) *Attorney, Agent, or Firm* — Cantor Colburn LLP

(57) ABSTRACT

An automatic machine for providing corrugated sheet-like elements includes elements for the continuous corrugation of a ribbon which moves in a longitudinal direction. The corrugation elements include an upper conveyor and a lower conveyor. The upper conveyor includes a plurality of upper abutment elements extended substantially transversely with respect to the longitudinal direction of motion of the ribbon. The lower conveyor includes a plurality of lower abutment elements extended substantially transversely with respect to the longitudinal direction of motion of the ribbon. The upper abutment elements are interleaved with the lower abutment elements in a work area. The upper abutment elements each include a bar adapted to make contact with the ribbon, while the lower abutment elements each include a vane, which has a substantially wedge-like transverse cross-section and is adapted to receive the ribbon in order to deform it.

6 Claims, 6 Drawing Sheets

(58) Field of Classification Search
USPC ..... 198/626.1
See application file for complete search history.

(56) References Cited

U.S. PATENT DOCUMENTS 3,157,551 A 11/1964 Granozio
3,887,418 A * 6/1975 Jurisich ..... B31D 3/02 156/197
3,972,763 A * 8/1976 Wolvin ..... B31F 1/2804 156/210
4,227,952 A * 10/1980 Sabee ..... A61F 13/15593 156/164
4,395,253 A * 7/1983 Goodman ..... B31C 1/06 493/109
4,678,457 A * 7/1987 Slobodkin ..... B26D 3/085 493/161
4,741,729 A * 5/1988 Edwards ..... B65D 71/504 294/87.2
4,795,414 A * 1/1989 Blumle ..... B26D 3/085 493/241
4,956,987 A * 9/1990 Hara ..... B21D 13/04 72/185
5,120,296 A * 6/1992 Yamaguchi ..... B01D 29/111 493/352
5,245,897 A * 9/1993 Arnold ..... B31D 3/0223 198/626.1
5,873,807 A * 2/1999 Lauderbaugh ..... B31B 50/00 493/403
6,450,230 B1 * 9/2002 Otruba ..... B65C 9/1807 156/542
6,682,468 B2 * 1/2004 Lauderbaugh ..... B31F 1/0025 493/396
7,017,463 B1 * 3/2006 Simpson ..... B26D 7/1818 493/472
8,088,054 B2 * 1/2012 Gordon ..... B31F 1/08 493/59
8,595,932 B2 * 12/2013 Day ..... B21D 13/04 29/6.1
2008/0011749 A1 * 1/2008 Cheich ..... B31D 5/0069 220/62
2009/0082187 A1 * 3/2009 Cheich ..... B31D 5/0047 493/350
2010/0024967 A1 * 2/2010 Gritti ..... B31F 1/305 156/205
2011/0053751 A1 * 3/2011 Arora ..... B31D 5/0047 493/464
2013/0034686 A1 * 2/2013 Mitsuno ..... D04H 3/14 428/131
2015/0119221 A1 * 4/2015 Tully ..... B31F 1/10 493/405
2017/0036411 A1 * 2/2017 Gritti ..... B31F 1/29
2018/0015683 A1 * 1/2018 Gritti ..... B31F 1/305

OTHER PUBLICATIONS

Written Opinion dated Apr. 13, 2016 re: Application No. PCT/EP2016/052081; pp. 1-5; citing: U.S. Pat. No. 3,157,551 A, FR 1 294 625 A and WO 2014/131667 A1.

* cited by examiner

AUTOMATIC MACHINE FOR PROVIDING CORRUGATED SHEET-LIKE ELEMENTS AND VANE FOR SAID MACHINE

TECHNICAL FIELD

The present disclosure relates to a machine for providing corrugated sheet-like elements.

BACKGROUND

Nowadays machines are known for providing corrugated sheet-like elements, of various materials, to be used, for example, for packaging, or for thermal or acoustic insulation.

Conventional machines usually comprise two chain conveyors, or formers, which move a plurality of transverse vanes, or bars, also known as rods, along a closed path.

In the known art, as disclosed in EP1620253B1 by the same Applicant, such rods are brought to the working position by a dedicated mechanism.

Specifically, the transverse vanes of each conveyor make up a kind of comb. The vanes of a conveyor face, in the work area (or formation area) of the corrugated sheet-like element, toward the vanes of the other conveyor, interleaving with them. The sheet-like element is thus pushed by the vanes of the two conveyors which, by mutually interleaving, press the sheet-like element thus creating the typical "wave" deformation of the element.

Such conventional machines also comprise means for bonding the corrugated sheet-like element thus obtained, to one or more other flat sheet-like elements, at the peaks of the formed corrugations, in order to provide a compound structure.

The conventional machines described above suffer the drawback of being very complex and expensive in that they use rods which are inserted to form the corrugation and are then extracted from the corrugation after the heat-sealing.

Other machines also exist which do not use rods but which instead form corrugations using only elastic materials such as for example expanded polyethylene.

Another category of conventional machines are the rotary machines that are typically used in the formation of cardboard. All manufacturers of such machines make use of roller formers provided with teeth, very similar to rounded gearwheels, which do not enable the formation of acute and right angles and which favor the formation of a sinusoidal corrugation.

Such conventional machines are also not devoid of drawbacks. In particular, such machines suffer limitations relating to the shape structure that they are capable of imparting to the corrugations of the corrugated sheet-like element. Specifically, such machines make it possible to provide substantially sinusoidal corrugations, in which the pitch-to-height ratio of the corrugation is substantially equal to 2.

Another drawback is constituted by the fact that the height of the corrugation is directly linked to the diameter of the roller formers. The impossibility of making rollers of excessively large diameter effectively limits the thickness of the cardboard to a height of 5 mm. If greater heights are needed, use is made in fact of the superimposition of multiple layers of cardboard.

However, theoretically, the ideal solution in order to optimize consumption of the material of which the corrugated sheet-like element is made and at the same time optimize the strength of the aforementioned compound structure provides a corrugation profile which is approximately triangular. In particular, the more acute the angle at the vertex of the triangle, the greater is the number of corrugations that can be provided for the same length, and therefore the greater is the resistance to compression of the compound structure.

The aim of the present disclosure is to provide a machine for providing corrugated sheet-like elements which solves the above-mentioned drawbacks and overcomes the limitations of the known art.

SUMMARY

Within this aim, the present disclosure devises a machine for providing corrugated sheet-like elements which can be used to process the most widely differing types of material, also including reduced-thickness rigid materials, such as for example paper or aluminum.

The disclosure relates to devising a machine for providing corrugated sheet-like elements which has a pitch-to-height ratio of the corrugation which is less than 2, in this manner succeeding in compacting a greater number of corrugations for the same length of the compound structure.

The disclosure further relates to devising a machine for providing corrugated sheet-like elements which is capable of working with heat-sealable poly-coated paper, and which makes it possible to stably couple even very thick cardboard with elements made of heat-sealable material, such as for example expanded polyethylene.

The disclosure also relates to devising a machine for providing corrugated sheet-like elements which is simple to make and operate and offers extremely reduced space occupation.

The disclosure includes devising a machine for providing corrugated sheet-like elements which is capable of working with paper with a high basis weight.

The disclosure further involves devising a machine for providing corrugated sheet-like elements that is capable of offering the widest guarantees of reliability and safety in use.

The disclosure also relates to devising a machine for providing corrugated sheet-like elements that is easy to implement and economically competitive when compared to the known art.

This aim and these and other advantages which will become better apparent hereinafter are achieved by providing an automatic machine for providing corrugated sheet-like elements, which comprises means for the continuous corrugation of a ribbon which moves in a longitudinal direction, said corrugation means comprising an upper conveyor and a lower conveyor, said upper conveyor comprising a plurality of upper abutment elements which are extended substantially transversely with respect to said longitudinal direction of motion of said ribbon, said lower conveyor comprising a plurality of lower abutment elements which are extended substantially transversely with respect to said longitudinal direction of motion of said ribbon, said upper abutment elements being interleaved between said lower abutment elements in a work area, characterized in that said upper abutment elements each comprise a bar adapted to make contact with said ribbon and in that said lower abutment elements each comprise a vane, which has a substantially wedge-like transverse cross-section and is adapted to receive said ribbon in order to deform it.

BRIEF DESCRIPTION OF THE DRAWINGS

Further characteristics and advantages of the disclosure will become better apparent from the detailed description of a preferred, but not exclusive, embodiment of a machine for providing corrugated sheet-like elements, which is illustrated for the purposes of non-limiting example with the aid of the accompanying drawings wherein.

DETAILED DESCRIPTION OF THE DRAWINGS

Figure 1:
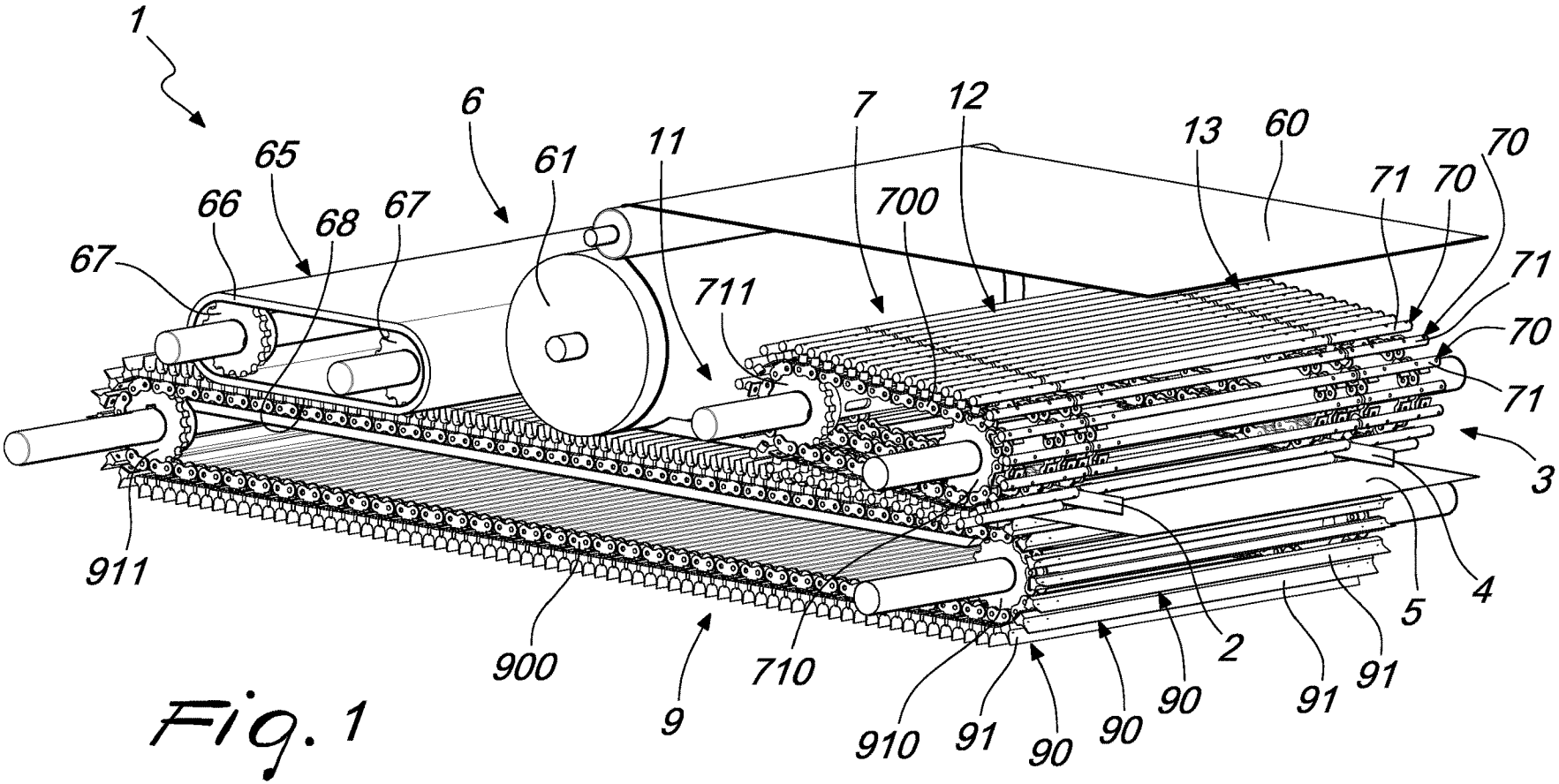
FIG. 1 is a perspective view of an embodiment of a machine for providing corrugated sheet-like elements, according to the disclosure.

With reference to the figures, the machine for providing corrugated sheet-like elements, generally designated by the reference numeral 1, comprises means 3 for the continuous corrugation of a ribbon 5 which moves in a longitudinal direction.

The corrugation means 3 comprise an upper conveyor 7 and a lower conveyor 9.

The upper conveyor 7 comprises a plurality of upper abutment elements 70 which are extended substantially transversely with respect to the longitudinal direction of motion of the ribbon 5.

The lower conveyor 9 comprises a plurality of lower abutment elements 90 which are extended substantially transversely with respect to the longitudinal direction of motion of the ribbon 5.

The upper abutment elements 70 interleave with the lower abutment elements 90 in a work area 11, where the corrugations of the ribbon 5 are formed.

According to the disclosure, the upper abutment elements 70 each comprise a bar 71 adapted to make contact with the ribbon 5, while the lower abutment elements 90 each comprise a vane 91, which has a substantially wedge-like transverse cross-section and is adapted to receive the ribbon 5 in order to deform it.

Advantageously, each bar 71 is substantially cylindrical, i.e. it has a substantially cylindrical cross-section.

The automatic machine 1 advantageously comprises at least one containment element 2, 4, arranged at the lower abutment elements 90, at least in the work area 11. The containment element 2, 4 is configured to keep the ribbon 5 engaged with the lower abutment elements 90.

Advantageously, the containment element 2, 4 has a longitudinal extension, in the longitudinal direction, that is also extended downstream of the work area 11. The containment element 2, 4 can advantageously be extended up until the fixing means 6, which are described hereinafter.

As illustrated by way of example in FIG. 1, there can be two containment elements 2, 4, each of which comprise a longitudinally-extended bar or plate.

Furthermore, also as illustrated in FIG. 1, the upper abutment elements 70 can be divided transversely into at least two sectors, and preferably into three sectors 11, 12, 13, where each one of the containment elements 2, 4 is arranged between two contiguous sectors 11, 12, 13.

In particular, the subdivision of the upper abutment elements 70 into two or three transverse sectors 11, 12, 13 is adapted to allow the insertion of the above-mentioned containment elements 2, 4 of the ribbon 5 between the upper abutment elements 70 and the lower abutment elements 90.

The fact of having the possibility of associating a plurality of transverse sectors each of which comprises a set of upper abutment elements 70, with which the containment elements 2, 4 are interleaved, makes it possible to provide corrugated sheet-like elements with lengths of over 3 meters.

The automatic machine 1 advantageously comprises, downstream of the work area 11, means 6 for fixing at least one flat ribbon 60 to the ribbon 5, in its corrugated configuration obtained in the passage through the work area 11.

The fixing means 6 can comprise an air heater, or an adhesive applicator, for heat-sealing the flat ribbon 60 to the ribbon 5.

An air heater, for example in the form of a hot roller, or a hot-air roller 61, as illustrated in the accompanying figures, is particularly adapted for thermally bonding a corrugated ribbon 5 of paper, or cardboard, which for example is very thick, to a flat ribbon 60 made of a material of the type of poly-coated paper. The heat-sealing occurs in particular at the apices of the corrugations of the corrugated ribbon 5.

An adhesive applicator on the other hand can advantageously be used to bond with adhesive a flat ribbon 60 made of a material of the type of usual paper to a corrugated ribbon 5 of paper or cardboard.

The fixing means 6 advantageously comprise a presser 65 which is configured to press the flat ribbon 60 against the ribbon 5, in its corrugated configuration.

The presser 65 advantageously comprises a belt 66, which unwinds continuously around a pair of sprockets 67, where at least one portion 68 of the belt 66 is adapted to press the flat ribbon 60 against the ribbon 5, in its corrugated configuration.

Advantageously, the vane 91, which has a substantially wedge-like transverse cross-section, has, in the end 92 adapted to make contact with the ribbon 5, a substantially flat abutment surface 93.

Figure 6:
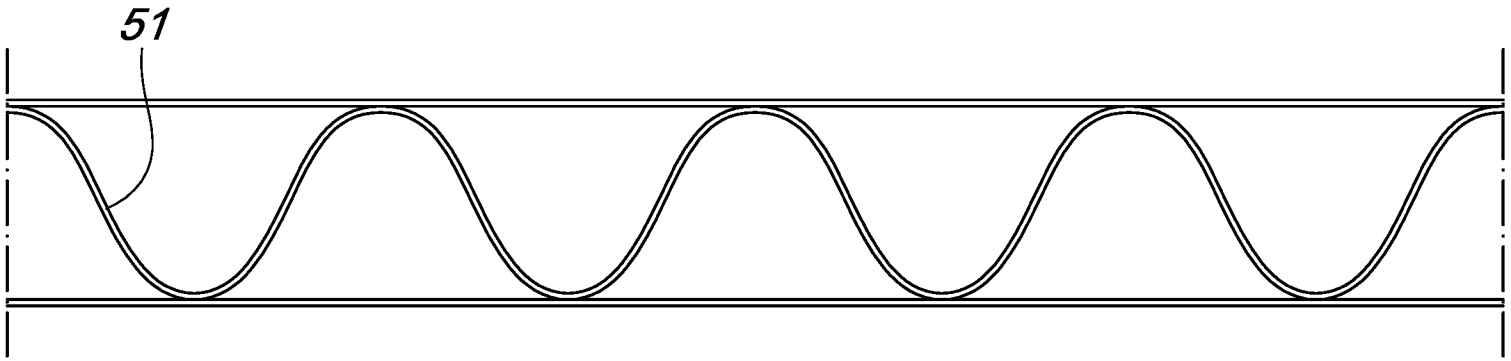
Fig. 6 PRIOR ART
FIG. 6 is a schematic diagram of a conventional structure composed of a corrugated sheet-like element comprised between two flat sheet-like elements.
Figure 7:
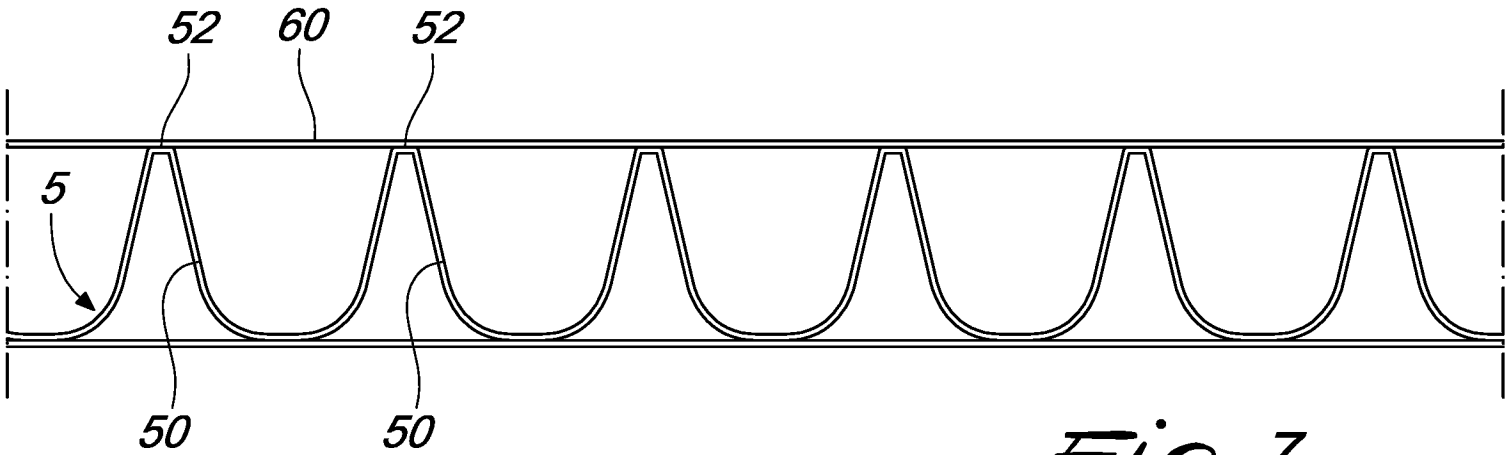
FIG. 7 is a schematic diagram of a structure which is composed of a corrugated sheet-like element comprised between two flat sheet-like elements and is made with a machine for providing corrugated sheet-like elements, according to the disclosure.

As shown for the purposes of example by comparing FIG. 6 with FIG. 7, the wedge-like shape structure of the transverse cross-section of the vane 91 is adapted to provide, in the layer 5, a corrugation 50 with a steeper profile than a corresponding sinusoidal corrugation 51 of a corrugated layer made with a conventional machine.

Furthermore, the substantially flat abutment surface 93 of the vane 91 is adapted to provide, in the layer 5, a corrugation 50 with an apex 52 that is at least partially flattened, in order to facilitate the subsequent fixing of the flat upper layer 60, by way of the fixing means 6.

The present disclosure also relates to a vane 91 for an automatic machine 1 for providing corrugated sheet-like elements starting from a ribbon 5, which has a substantially wedge-like transverse cross-section.

Figure 2:
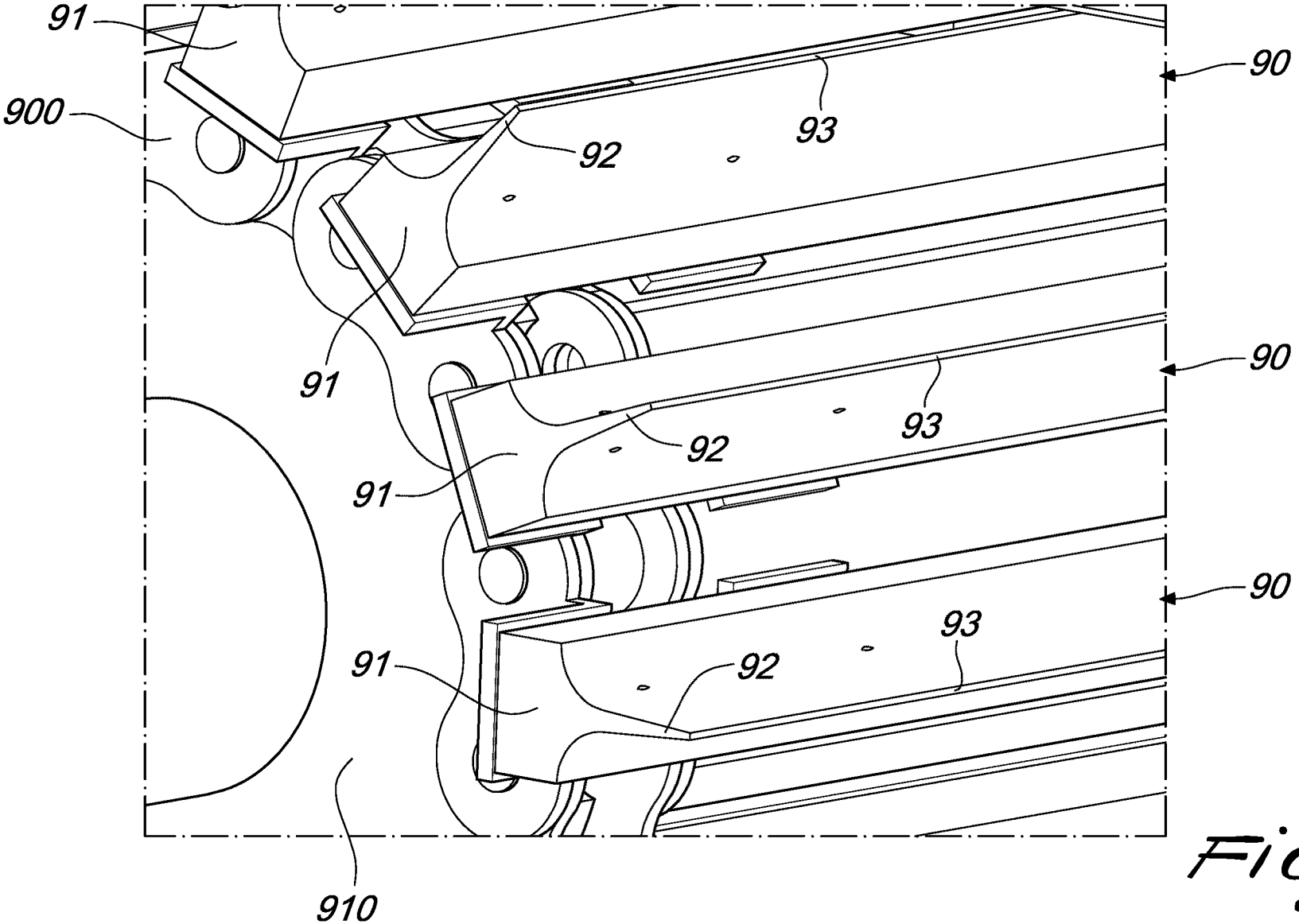
FIG. 2 is an enlarged portion of FIG. 1, illustrating in particular the lower abutment elements of the lower conveyor of the machine in FIG. 1, according to the disclosure.
Figure 3:
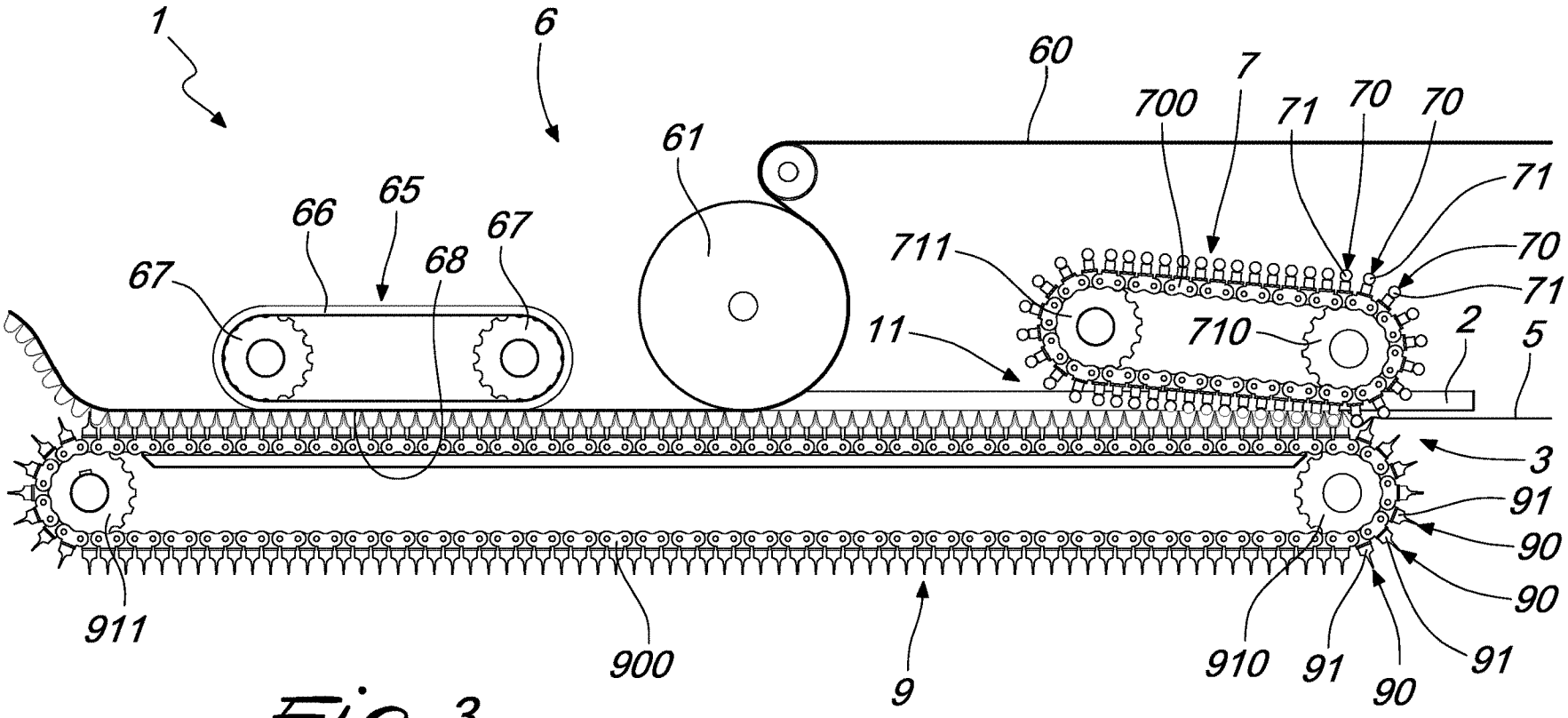
FIG. 3 is a schematic side view of the machine of FIG. 1, according to the disclosure.
Figure 4:
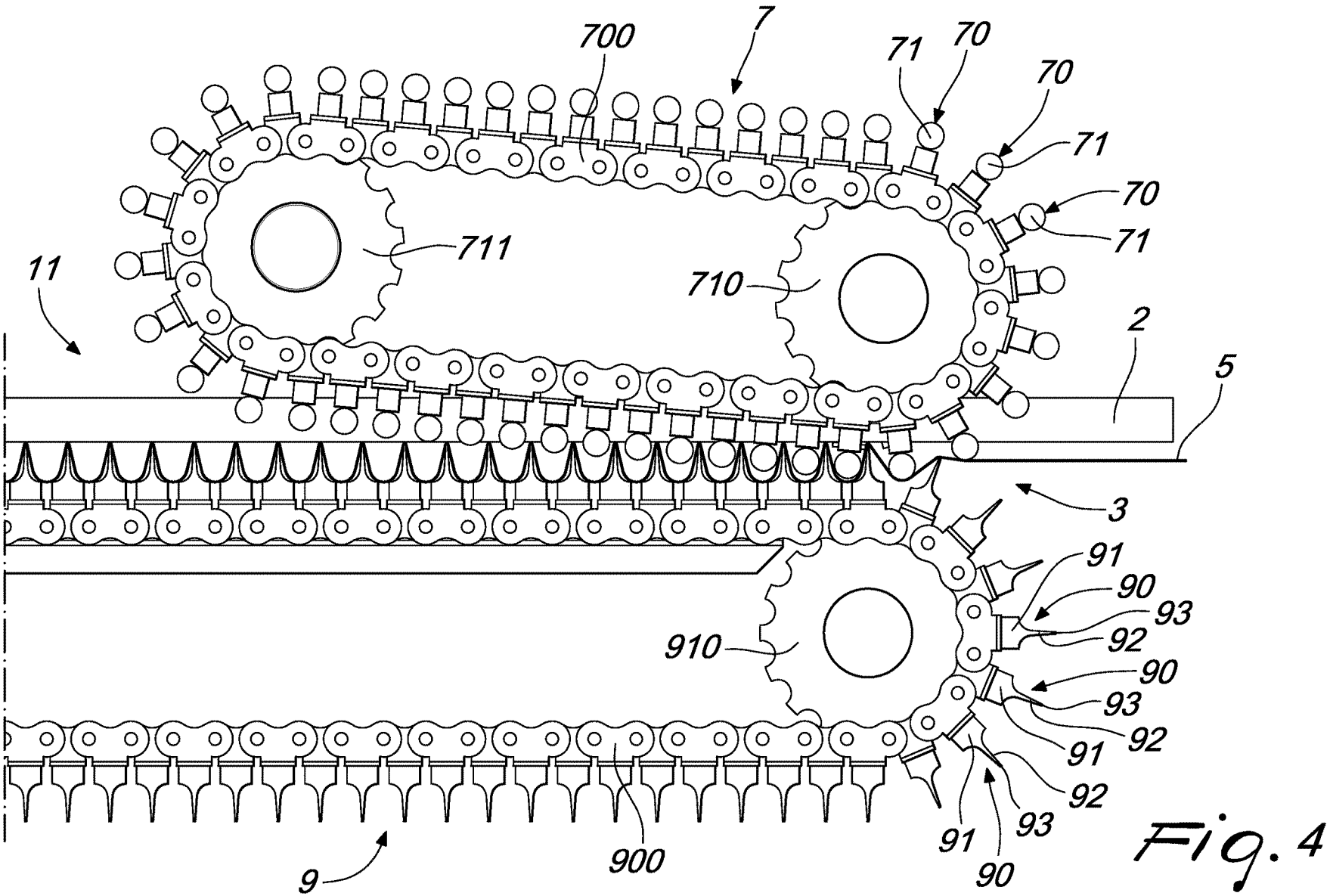
FIG. 4 is an enlarged portion of FIG. 2, illustrating in particular the work area between the upper conveyor and the lower conveyor of the machine in FIG. 1, according to the disclosure.

As illustrated in FIG. 2, the vane 91 advantageously comprises a substantially parallelepiped base body which is adapted to be associated with the lower conveyor 9, and preferably with the links of the lower chain 900. From such base body of the vane 91 extends the portion of the vane 91 which has a substantially wedge-like transverse cross-section. Such wedge-like portion has, at the end 92, the abutment surface 93, while at the opposite end it advantageously has two curved profiles which are connected to the base body.

In an alternative embodiment of the vane 91, not shown in the accompanying figures, the substantially wedge-like transverse cross-section assumes a shape of an acute triangle the vertex of which at the end 92 is flattened. Advantageously, the upper conveyor 70 and the lower conveyor 90 each comprise respectively an upper chain 700 and a lower chain 900, which unwinds continuously, where the upper abutment elements 70 and the lower abutment elements 90 are respectively associated with the links of the upper chain 700 and of the lower chain 900. At least in the work area 11, the upper chain 700 can define an upper direction of movement of the upper abutment elements 70 which is inclined with respect to the lower direction of movement of the lower abutment elements 90 which is defined by the lower chain 900. In this manner, the upper abutment elements 70, in their motion along the upper direction of movement, move away transversely from the lower abutment elements 90, freeing the corrugations of the ribbon 5 which have just been formed in the work area 11.

Advantageously, the upper conveyor 7 comprises at least two upper sprockets 710 and 711 with which the upper chain 700 is associated. Similarly, the lower conveyor 9 can also comprise at least two lower sprockets 910 and 911 with which the lower chain 900 is associated. At least one upper sprocket 710 can be kinematically connected to at least one lower sprocket 910, so that the rotation of the upper sprocket 710 determines the rotation of the lower sprocket 910 or vice versa.

Figure 5:
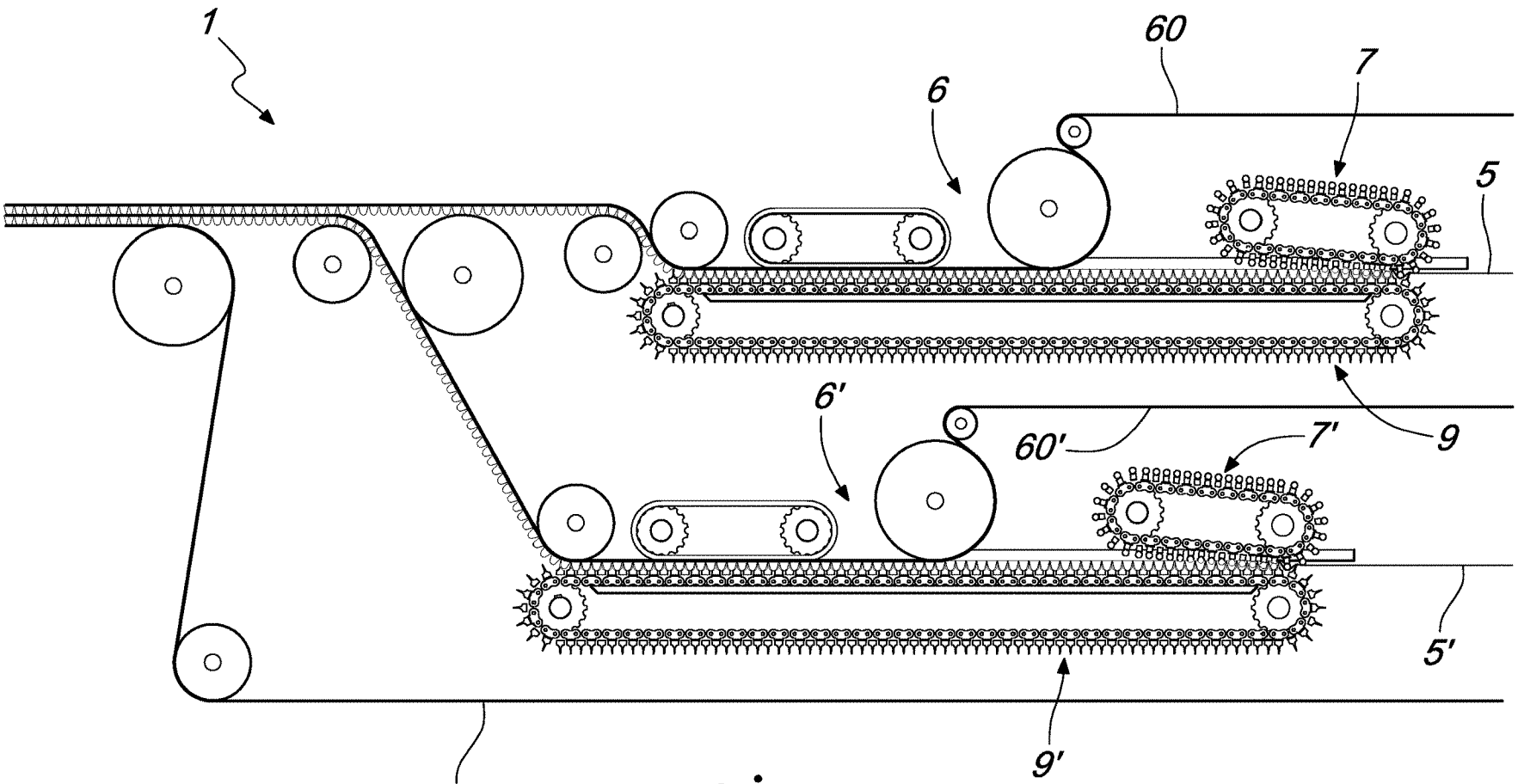
FIG. 5 is a schematic side view of a further embodiment of a machine for providing corrugated sheet-like elements, according to the disclosure.

FIG. 5 shows a further embodiment of a machine for providing corrugated sheet-like elements, which is configured to provide a structure composed of two corrugated layers.

The machine 1 comprises a first upper conveyor 7 which cooperates with a first lower conveyor 9 to provide a first corrugated layer starting from a first ribbon 5, which is coupled, by way of first fixing means 6, to a first flat layer 60.

The machine 1 further comprises a second upper conveyor 7' which cooperates with a second lower conveyor 9' to provide a second undulating layer starting from a second ribbon 5', which is coupled, by way of second fixing means 6', to a second flat layer 60'.

The structure made up of the first corrugated ribbon and of the first flat ribbon is then conveniently coupled to the structure made up of the second undulating ribbon and of the second flat ribbon. Advantageously, the structure thus obtained is coupled to a further flat ribbon 60", so as to provide a structure with a double corrugated layer.

Operation of the machine for providing corrugated sheet-like elements is clear and evident from the foregoing description.

In practice it has been found that the machine for providing corrugated sheet-like elements, according to the present disclosure, achieves the intended aim and advantages in that it makes it possible to provide corrugated sheet-like elements in which the pitch-to-height ratio of the corrugation provided is less than 2. In this manner, for the same length of the corrugated sheet-like element, the number of corrugations is about 30-40% higher with respect to the number obtainable with conventional machines.

For example, the machine for providing corrugated sheet-like elements, according to the disclosure, makes it possible to provide corrugated layers with a pitch-to-height ratio of the corrugation equal to about 1.27, i.e. in which the pitch is approximately ¾ of an inch and the height of the corrugation is 15 millimeters, or in which the pitch is approximately half an inch and the height of the corrugation is 10 millimeters.

Obviously, it is also possible to obtain pitch-to-height ratios of the corrugation which are higher than 1.5.

Furthermore, it follows from this that the compound structure as provided by the machine for providing corrugated sheet-like elements, according to the disclosure, has a greater resistance to compression.

Another advantage of the machine for providing corrugated sheet-like elements, according to the disclosure, is that it is possible to work on papers with high basis weights, which have better properties of resistance to compression.

Another advantage of the machine for providing corrugated sheet-like elements, according to the disclosure, is that it is possible to provide compound structures starting from the most widely differing types of materials, including paper, cardboard, very thick cardboard, aluminum, poly-coated paper and elastic materials such as expanded polyethylene. For example, in this manner it is possible to provide new types of structures, in which, for example, it is possible to stably couple very thick cardboard and elements made of heat-sealable material.

Another advantage of the machine for providing corrugated sheet-like elements, according to the disclosure, relates to providing corrugated configurations that are well-defined and precise.

The machine for providing corrugated sheet-like elements thus conceived is susceptible of numerous modifications and variations all of which are within the scope of the appended claims.

Moreover, all the details may be substituted by other, technically equivalent elements.

In practice the materials employed, provided they are compatible with the specific use, and the contingent dimensions and shapes, may be any according to requirements.

The invention claimed is:

1. An automatic machine for providing corrugated elements, said automatic machine comprises an upper conveyor and a lower conveyor, said upper and lower conveyors configured for a continuous corrugation of a ribbon which moves in a longitudinal direction of motion, said upper conveyor comprising a plurality of upper abutment elements extended transversely with respect to said longitudinal direction of motion, said lower conveyor comprising a plurality of lower abutment elements extended transversely with respect to said longitudinal direction of motion, said automatic machine comprising a work area wherein said upper abutment elements are interleaved between said lower abutment elements, wherein said upper abutment elements each comprise a bar adapted to make contact with said ribbon and said lower abutment elements each comprise a vane, which has a wedge-shaped transverse cross-section and which is adapted to receive said ribbon in order to deform said ribbon, said automatic machine further comprising at least one containment element arranged at said lower abutment elements at least in said work area, said at least one containment element being configured to keep said ribbon engaged with said lower abutment elements, said at least one containment element having a longitudinal extension, in said longitudinal direction of motion, that is extended downstream of said work area, said upper abutment elements divided transversely with respect to said longitudinal direction of motion into at least two transverse sectors, said at least one containment element being arranged between said at least two transverse sectors.

2. The automatic machine according to claim 1, further comprising, downstream of said work area, a fixing device configured to fix a flat ribbon to said ribbon in a corrugated configuration obtained in a passage through said work area.

3. The automatic machine according to claim 2, wherein said fixing device comprises a presser configured to press said flat ribbon and said ribbon in the corrugated configuration.

4. The automatic machine according to claim 3, wherein said presser comprises a belt, at least one portion of said belt pressing against said flat ribbon and said ribbon in the corrugated configuration.

5. The automatic machine according to claim 1, wherein said vane, which has a wedge-shaped transverse cross-section, comprises an end adapted to make contact with said ribbon, said end having a flat abutment surface.

6. The automatic machine according to claim 1, wherein said upper abutment elements have a circular transverse cross-section.

* * * * *